United States Patent [19]

Bruggeman

[11] 3,930,756

[45] Jan. 6, 1976

[54] METERING PULSE PUMP

[75] Inventor: William L. Bruggeman, White Bear Lake, Minn.

[73] Assignee: Cat Pumps Corporation, Minneapolis, Minn.

[22] Filed: Jan. 14, 1974

[21] Appl. No.: 433,132

[52] U.S. Cl. ..... 417/199 A; 417/245; 417/382; 417/383; 417/511; 417/539; 137/529

[51] Int. Cl.[2] ..... F04G 23/04; F04B 17/00; F04B 9/08

[58] Field of Search ..... 417/245, 199 A, 383, 511, 417/388, 382, 385, 539; 137/99, 529

[56] References Cited

UNITED STATES PATENTS

| | | | |
|---|---|---|---|
| 3,032,060 | 5/1962 | Huffman | 137/529 X |
| 3,121,373 | 2/1964 | Murphy et al. | 137/529 X |
| 3,235,129 | 2/1966 | Kruckeberg | 417/382 |
| 3,450,053 | 6/1969 | McCulloch | 417/382 |
| 3,663,122 | 5/1972 | Kitchen | 417/269 |
| 3,680,981 | 8/1972 | Wagner | 417/388 |
| 3,692,433 | 9/1972 | Finger | 417/382 |
| 3,809,508 | 5/1974 | Uchiyama | 417/511 |

*Primary Examiner*—C. J. Husar
*Assistant Examiner*—Richard E. Gluck
*Attorney, Agent, or Firm*—James R. Haller; H. Dale Palmatier

[57] ABSTRACT

A metering pulse pump for metering an additive liquid into a liquid carrier under high pressure. A high-pressure, rapidly reciprocating piston pump is provided at its outlet end with a pressure-relief valve including a spring pressure control permitting the valve to open under varying pre-set pressure differentials across the valve. A diaphragm pump having first and second chambers separated by a diaphragm is provided with one of the chambers communicating directly with the outlet of the piston pump upstream of the pressure-relief valve, liquid carrier emitted under pressure from the piston pump serving to drive the diaphragm pump in a pumping stroke, the second chamber of the diaphragm pump having inflow and outflow ports with respective check valves permitting only inflow and outflow of an additive liquid into and out of the second chamber. The first and second chambers of the diaphragm pump are communicated through a manually closable bleeder duct having a check valve permitting flow only from the first chamber to the second chamber when the duct is open. The length of a diaphragm pumping stroke corresponding to a rapid piston pump stroke is controlled by the pressure differential setting of the pressure-relief valve.

12 Claims, 4 Drawing Figures

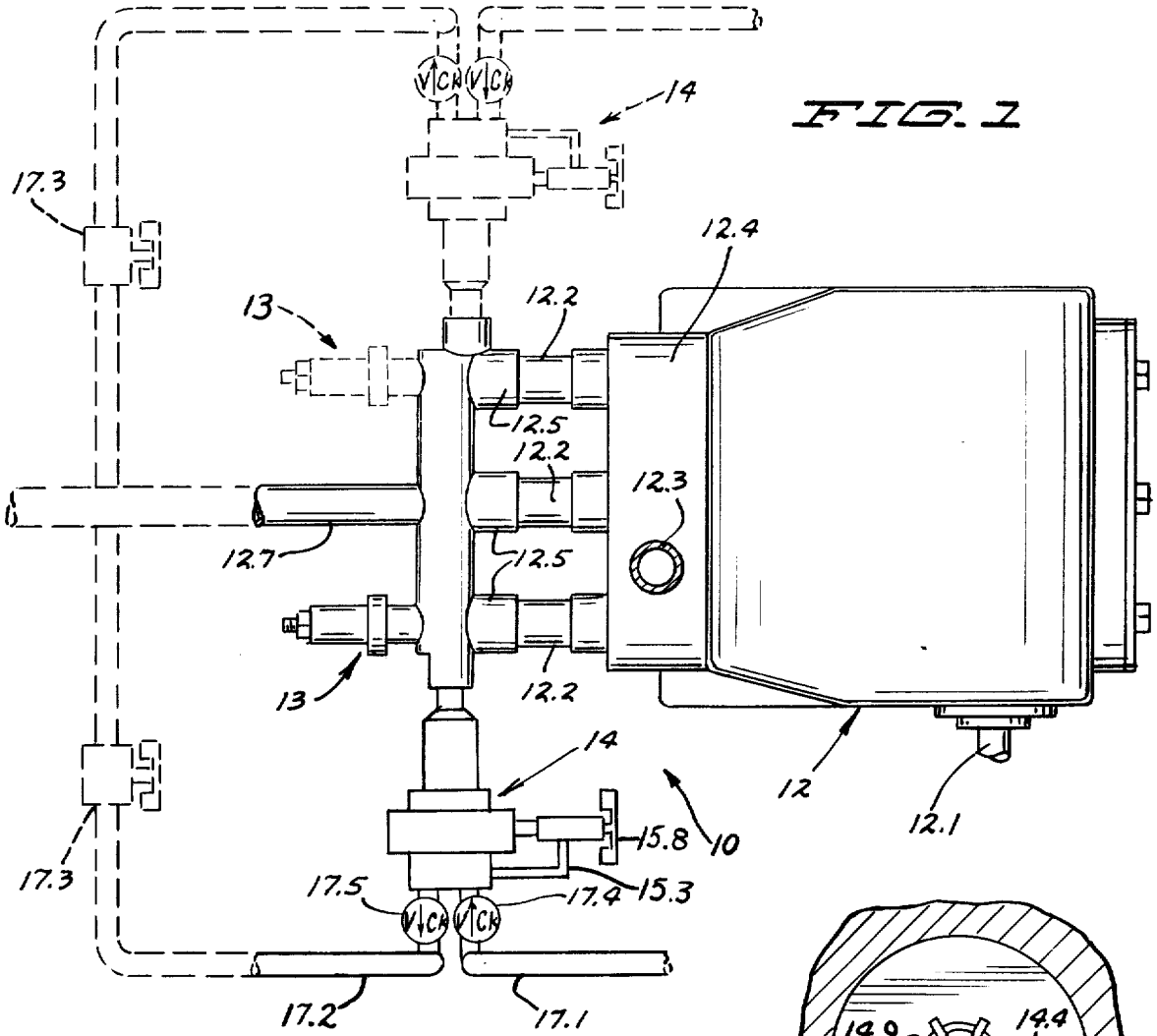
FIG. 1
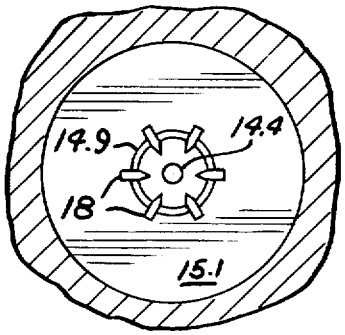
FIG. 4
FIG. 2
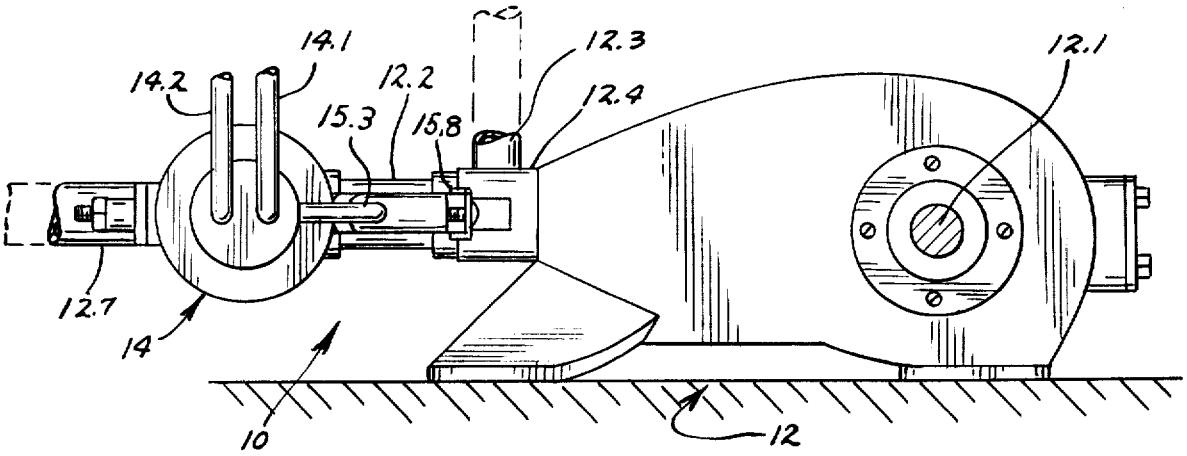

17.5
17.4
V CK
V CK
17.1
20
21
15.3
17.2
15.2
15.1
14.3
14.6
4
4
15.1
14.5
14.1
14.2
14.8
15.5
15.4
15.7
15.6
15.8
18
14.4
14.9
14
17.3
14.7
15
10
12
13
13.4
13.3
16.7
12.2
16.2
16.5
16.3
16.4
13.8
16.1
13.5
13.6
13.2
13.1
16.6
12.5
16.8
16.3
16.1
12.8
12.7
12.6
16.2
12.2
12.4
12.3
50
16.6
16.1
16.8
12.5
16.5
16.3
16.4

METERING PULSE PUMP

BACKGROUND OF THE INVENTION

Various devices have been employed for automatically metering small amounts of an additive liquid to the mainstream of a liquid carrier. When the liquid carrier is under high pressure, however, highly sophisticated and hence expensive metering pumps such as gear pumps ordinarily are employed. An inexpensive apparatus which would permit an additive liquid to be metered to a liquid carrier under high pressure is much to be desired.

SUMMARY OF THE INVENTION

The present invention relates to a metering pulse pump for metering an additive liquid into a liquid carrier under high pressure. The pulse pump comprises a piston pump with an inlet connectable to a source of liquid and an outlet, and which is capable of rapid reciprocation to deliver liquid at high pressures. A diaphragm pump is provided with a housing and a movable diaphragm separating the housing into a first chamber communicating directly with the outlet of the piston pump and a second chamber having inflow and outflow ports. The latter ports respectively have check valves permitting flow only into and out of the second chamber. Mounted at the outlet of the piston pump is a unidirectional flow pressure-relief valve having a plug, a valve seat, a spring urging the plug and valve seat into a closed position, and a control such as an externally operable valve stem for varying pressure of the spring to control the pressure differential across the pressure-relief valve at which the valve will open. The length of a diaphragm pumping stroke corresponding to a rapid piston pump stroke may thus be pre-set by control of the spring pressure of the check valve at the outlet of the piston pump.

BRIEF DESCRIPTION OF THE DRAWING

FIG. 1 is a top view, partially schematic and partially broken away, of a metering pulse pump of the invention;

FIG. 2 is a partially schematic side view of the pump of FIG. 1, shown partially broken away;

FIG. 4 is a broken away, cross section view taken along line 4—4 of FIG. 3.

DETAILED DESCRIPTION OF THE PREFERRED EMBODIMENT

Figure 3:
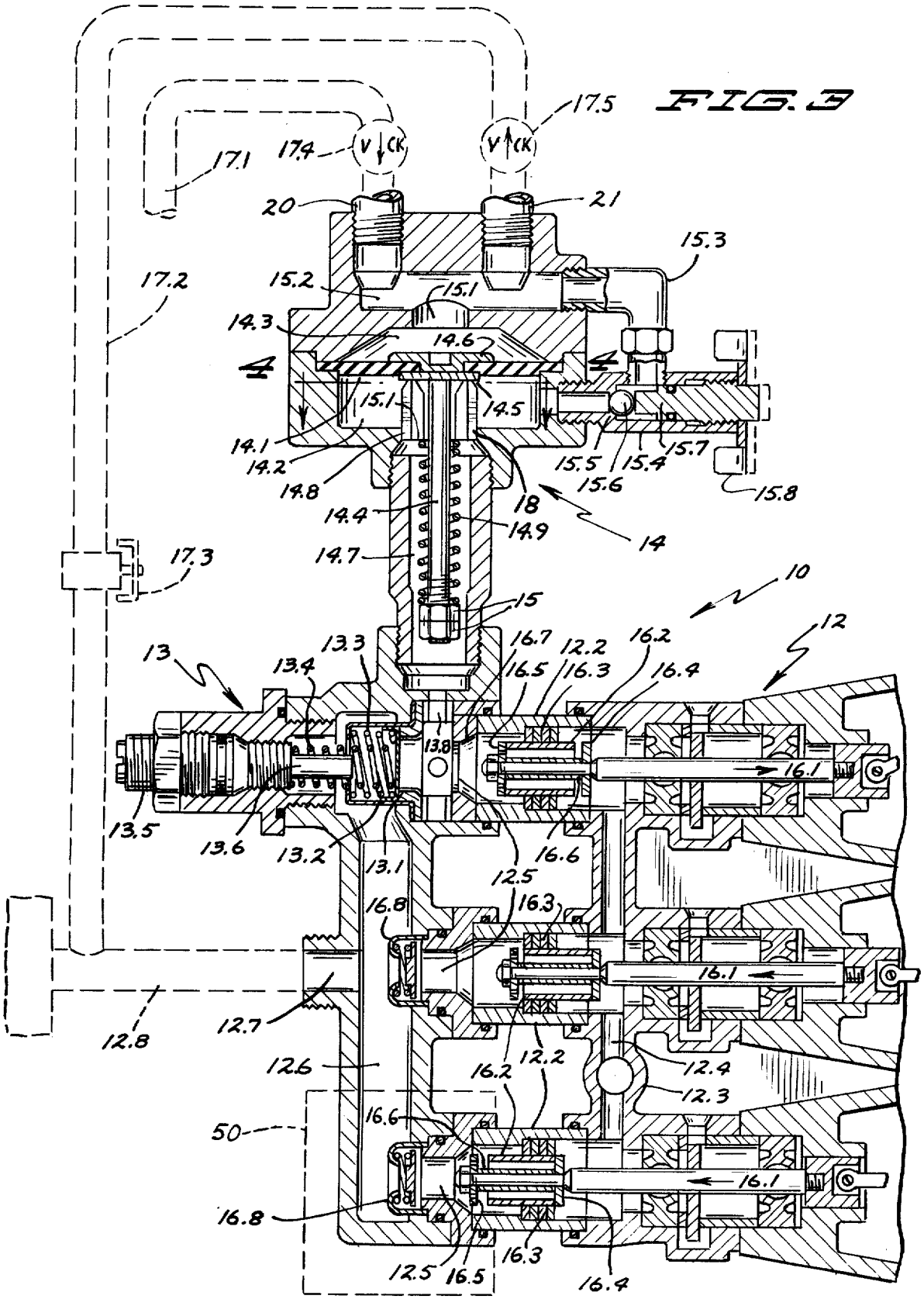
FIG. 3 is a semi-schematic top view in partial cross section and partially broken away of a pulse pump of the invention.

Referring to FIGS. 1 and 2, the metering pulse pump of the invention is designated generally as 10 and includes a multi-piston pump and a diaphragm pump designated generally as 12 and 14, respectively. The multi-piston pump 12 includes a rotating drive shaft 12.1 driven by an external power source and has one or more cylinders 12.2 through which pistons reciprocate, as will be more fully described below. The multi-piston pump has an inlet port 12.3 through which water or other liquid is introduced into an inlet manifold 12.4. The pump has outlet ports 12.5 which are joined to an outlet manifold 12.6 by unidirectional flow valves 16.8 which permit liquid to flow only into the latter manifold. To one or more of the outlets 12.5 of the multi-piston pump are connected diaphragm pumps 14, and each diaphragm pump is connected directly to its respective piston pump outlet 12.5 upstream from the associated unidirectional flow valve. Each of the latter valves which are associated with a piston pump connected to a diaphragm pump is a spring-loaded pressure-relief valve and is provided with a control for pre-setting spring pressure so that each such valve may be made to open when a pre-set pressure differential is applied across the valve, the water or other liquid which is pumped by the piston pump passing into the outlet manifold 12.6 once the spring-loaded check valve has opened. Prior to opening of the latter valve, the pressure of liquid pumped by the piston pump serves to drive the diaphragm pump in a pumping stroke.

The diaphragm pump has a conduit 17.1 communicating with a reservoir of additive liquid and a conduit 17.2 which conveys the additive liquid pumped by the diaphragm pump outwardly. The latter conduit 17.2 may have a needle valve 17.3 serving as a downstream obstruction to retard the flow of additive liquid and to thus retard the speed of the stroke of the diaphragm pump. The additive liquid conduits 17.1 and 17.2 are connected to the diaphragm pump by check valves 17.4 and 17.5 which respectively permit the additive liquid to flow only into and only out of the diaphragm pump. Downstream from the needle valve 17.3, the conduit 17.2 communicates with an outlet line 12.8 leading from the outlet manifold 12.6 of the multi-piston pump.

As the controlled, spring-loaded pressure-relief valve at the outlet of a piston pump is adjusted so as to require greater and greater pressure differentials thereacross before opening, the pressure of liquid from the piston pump upon the diaphragm increases, and the diaphragm is more speedily moved through its pumping stroke. If the pressure-relief valve is adjusted so as to open only when extremely high pressure differentials are applied across it, then the diaphragm pump will essentially complete its pumping stroke before its associated, rapidly reciprocating piston pump begins its return stroke. On the other hand, if the pressure-relief valve is adjusted so as to open under application of only a very small pressure differential, then the pressure differential across the diaphragm will likewise be small, resulting in a reduction in the speed of the pumping stroke of the diaphragm pump so that the latter pump does not complete its stroke before the piston pump begins its return stroke. Since the quantity of additive liquid which is pumped through the diaphragm pump is dependent upon how far the diaphragm moves, e.g., upon the degree to which the diaphragm pump completes its pumping stroke, the amount of additive liquid which is pumped by the diaphragm pump is dependent upon the speed of movement of the diaphragm in its pumping stroke. By judicious adjustment of the controlled, spring-loaded pressure-relief valve, the amount of additive liquid which is pumped by the diaphragm pump in each pumping stroke may be controlled. Fine adjustments in the flow of additive liquid from the diaphragm pump may be made by adjusting the needle valve 17.3 downstream from the diaphragm pump.

The multi-piston pump shown in the drawing includes three piston and cylinder combinations, and in FIG. 3, only one of the piston-cylinder combinations is shown connected to a diaphragm pump. It will be understood that one or more of the remaining piston-cylinder combinations may also be connected to diaphragm pumps, if desired, to meter several additive liquids into a mainstream of carrier liquid. The presence of a second diaphragm pump in FIG. 3 is denoted by dashed line 50 and is also represented in dashed lines in FIG. 1.

With reference now to FIG. 3, each piston-cylinder combination of the multi-piston pump 12 includes a piston rod 16.1 which is journaled for reciprocation in the piston pump housing and which extends into the cylinder 12.2. A lightweight, reciprocable tube 16.2 is centered longitudinally within the cylinder 12.2 and is supported within the cylinder solely by an annular packing 16.3, the tube 16.2 being slidable axially within the cylinder against the packing. The piston rod 16.1 extends through the reciprocable tube 16.2 and is provided with a valve disc 16.4 and a perforate retainer disc 16.5 rigidly mounted on the rod in spaced, confronting relationship and separated by a spacer 16.6, the space between the discs 16.5 and 16.4 being slightly greater than the length of the reciprocable tube 16.2. The discs 16.4 and 16.5 alternately bear against the ends of the reciprocable tube 16.2 during reciprocation of the piston rod 16.1. In the topmost piston-cylinder combination shown in FIG. 3, the piston rod 16.1 has completed a pumping stroke and is part way through its return stroke. Liquid entering the inlet manifold 12.4 through the port 12.3 thus enters the cylinder 12.2 by traveling inwardly through the space separating the reciprocable tube 16.2 from the valve disc 16.4, and thence through the interior of the tube 16.2 and outwardly through the perforated retainer disc 16.5, the return stroke of the piston rod drawing substantially no vacuum within the downstream end 16.7 of the cylinder. In the bottom-most piston-cylinder arrangement shown in FIG. 3, the piston has nearly completed its pumping stroke, the valve disc 16.4 bearing against and sealing the open, rearmost end of the reciprocable tube 16.2 so that the forward motion of the tube through the annular gasket 16.3 carries liquid forwardly of the cylinder and through the outlet port 12.5. In FIG. 3, the bottom two piston-cylinder combinations are not connected to diaphragm pumps, and may employ simple, spring-loaded unidirectional flow valves 16.8 which permit flow into the manifold during the pumping stroke but prevent return flow.

The topmost piston-cylinder combination in FIG. 3 is provided with controllable, spring-loaded unidirectional flow pressure-relief valve designated generally as 13. The latter valve includes an annular valve seat 13.1 against which is seated a dished valve disc 13.2. The valve disc 13.2 is held against the seat 13.1 by a pair of helical compression springs 13.3, 13.4, the former spring being retained within the housing of the valve so as to exert continuous pressure against the valve disc 13.2, urging the valve disc against the seat 13.1. A valve stem 13.5 is threaded into the adjustable check valve housing and protrudes from the housing to terminate in a slotted end adapted to receive a screwdriver. Internally of the check valve housing, the stem 13.5 is provided with a shoulder which abuts the compression spring 13.4, and includes a centering rod 13.6 which extends into the helical spring 13.4 to center the spring on the stem 13.5. The centering rod 13.6 terminates in an end which may, if desired, abut against the valve 13.2 when the stem has been turned fully into the check valve housing, thereby providing a positive barrier to flow of liquid between the valve 13.2 and valve seat 13.5. As the stem 13.5 is turned outwardly from the housing, the compressive force exerted by the shoulder of the stem against the compression spring 13.4 is diminished, lessening the pressure differential which must be applied across the valve 13.2 in order to open the valve and permit liquid to escape into the outlet manifold 12.6. Because of the presence of compression spring 13.3, however, some pressure differential will always be required to open the pressure-relief valve 13.

The diaphragm pump 14 has a housing defining a compartment, and has movable diaphragm 14.1 which separates the compartment into a first chamber 14.2 and a second chamber 14.3. A reciprocable pin 14.4 is attached at its upper end to the center of the diaphragm by retaining discs 14.5 and 14.6, the housing of the diaphragm pump including walls defining an elongated extension 14.7 of the chamber 14.2 and which encloses the pin 14.4. The walls of the chamber are threaded at their outer end into the housing of the pressure-relief valve 13, the chamber 14.7 communicating directly with the outlet 12.5 of the piston pump through an orifice 13.8. A series of bladelike projections 18 which are rigidly mounted internally to the diaphragm pump housing and are oriented axially with respect to the pin 14.4 extend into the chamber 14.2 to terminate at their outer ends in stationary bearing surfaces against which the retaining disc 14.5 may rest when the diaphragm has completed its return stroke and is in its retracted position as depicted in FIG. 3. The projections 14.8 are spaced circumferentially of the pin 14.4 so that the first chamber 14.2 of the diaphragm pump communicates freely between the bladelike projections with the chamber extension 14.7 and the outlet 12.5 of the piston pump. A helical compression spring 14.9 is centered about the pin 14.4, and is retained upon the pin at one end by lock nuts 15 which provide an outwardly extending shoulder against which one end of the spring may rest, the other end of the spring resting against the inwardly extending shoulder 15.1 of the bladelike projections 14.8. The lock nuts 15 may be moved axially on the pin 14.4 to vary the force exerted by the spring 14.9 on the diaphragm. The compression spring 14.9 need not be of great strength, the spring serving only to return the diaphragm to its retracted position following a pumping stroke of the piston pump, since there is substantially no vacuum produced at the outlet 12.5 of the piston pump when the piston rod is engaged in its return stroke. Because of the large area of the diaphragm which encounters pressurized liquid within the first chamber 14.2, the force exerted by the helical spring 14.9 is negligible, the pressure differential required to move the diaphragm in a pumping stroke being always less than the pressure differential reuired to open the pressure-relief valve 13.

The second chamber 14.3 of the diaphragm pump extends through a port 15.1 into an enlarged manifold 15.2. A bleeder duct 15.3 joins the manifold 15.2 with the first chamber 14.2 of the diaphragm pump through a check valve 15.4. The latter valve includes an valve seat 15.5 and a ball plug 15.6 which seats against the valve seat, the valve seat and valve being oriented to permit flow only from the first chamber 14.2 into the manifold 15.2 of the second chamber 14.3. The check valve 15.4 includes a valve pin 15.7 threaded into the check housing and terminating in an end adapted to contact the ball 15.6 and force the same into seating engagement against the valve seat 15.5. The stem 15.7 has an exterior handle 15.8 so that the stem may be turned into or out of the valve. As will be explained more fully below, the check valve 15.4 and pin 15.7 are employed during start up of the pulse pump of the invention.

The diaphragm pump is provided with inflow and outflow ports 20, 21 communicating with the manifold 15.2 of the second chamber 14.3. Inflow port 20 is provided with a check valve 17.4 permitting additive liquid to flow only into the manifold 15.2, and outflow port 21 is provided with a check valve 17.5 permitting additive liquid only to flow out of the manifold. These check valves may be of the ball and valve seat type previously described. To the check valve 17.4 is attached an inflow conduit 17.1 which in turn may lead to a reservoir of additive liquid. An outflow conduit 17.2 is attached to the check valve 17.5 and extends outwardly for eventual communication with fluid conduit 12.8 which leads outwardly from the outlet manifold 12.6 and which provides liquid under pressure, including a metered amount of additive liquid, to a destination downstream, the downstream destination providing resistence to flow so that pressures within the manifold and conduit 12.8 are maintained at a high level.

The outflow conduit 17.2 is provided along its length with a needle valve 17.3, or a restricted orifice, or some other flow restricting means which retards the flow of additive liquid through the conduit 17.2 and thus tends to retard the speed of the pumping stroke of the diaphragm pump 14.

In operation, the lower two piston pumps of FIG. 3 continuously deliver water or other fluid under pressure into manifold 12.6, the pumped liquid proceeding through the outlet port 12.7 in the manifold and through the conduit 12.8 to an eventual destination. The output from the uppermost piston pump in FIG. 3, however, is blocked from entering the manifold 12.6 by the controllable, spring-loaded pressure-relief valve 13, and when the stem 13.5 has been adjusted so that the spring 13.4 exerts considerable pressure against the valve disc 13.2, the pressure within the outlet 12.5 of the upper piston pump may substantially exceed the pressure within the manifold 12.6. The liquid thus pumped by the uppermost piston pump in FIG. 3 passes through the orifice 13.8 in the pressure-relief valve housing, and through the annular chamber extension 14.7 into the first chamber 14.2 of the diaphragm pump, exerting force upon the diaphragm. When the pressure differential across the diaphragm reaches some minimum value, the diaphragm will begin its pumping stroke (upward in FIG. 3), causing additive liquid which is contained within the chamber 14.3 to flow outwardly through the port 21, check valve 17.5 and conduit 17.2 through the needle valve 17.3 and thence into the conduit 12.8 leading from the piston pump manifold 12.6. Depending upon the spring pressure in the controllable pressure-relief valve 13, the continuously rising pressure differential across the adjustable check valve disc 13.2 will eventually become sufficient to overcome the tension provided by helical springs 13.4 and 13.3, and the valve 13 will open and permit liquid under pressure to pass into the manifold 12.6. As the uppermost piston pump in FIG. 3 begins its return stroke, the pressure-relief valve 13 immediately closes as does the outflow check valve 17.5 of the diaphragm pump. The pressure differential across the diaphragm 14.1 thus is lost, and the diaphragm is returned to its retracted position by action of the compression spring 14.9 upon the pin 14.4, the retaining disc 14.5 of the diaphragm coming to rest against the bearing surfaces of the bladelike projections 14.8. Return of the diaphragm in this manner creates a vacuum within the second chamber 14.3, additive liquid thus being drawn into the latter chamber through the inflow conduit 17.1, check valve 17.4 and inflow port 20. As the piston pump begins another pumping stroke, the pressure generated by the corresponding pumping stroke of the diaphragm pump closes the check valve 17.4 and opens the check valve 17.5, and the process thus described is repeated.

The downstream flow resistence in the outflow conduit 17.2 of the diaphragm pump, as represented by needle valve 17.3, resists the flow of additive liquid through the outflow conduit. As the diaphragm moves through its pumping stroke, the pressure within the conduit 17.2 increases more rapidly than if the flow restriction were absent, and this back pressure, together with the back pressure generated downstream as the liquid is passed to its ultimate destination, tends to retard the speed at which the diaphragm moves during its pumping stroke. Since the piston pump reciprocates very rapdily (500–1000 reciprocations per minute), there is only a very short time interval during which a pressure differential is applied across the diaphragm. If, during this interval, the diaphragm does not complete its pumping stroke, a reduced quantity of additive liquid will be metered into the conduit 12.8 leading from the piston pump manifold 12.6. The speed with which the diaphragm moves during its pumping cycle thus determines the quantity of additive liquid which is metered, and is dependent on the pressure differential across the diaphragm, increasing pressure differentials giving rise to increasing speeds of the diaphragm in its pumping stroke. The pressure differential across the diaphragm, in turn, is a function of the degree of flow restriction provided by the needle valve 17.3, and the pressure within the conduit 12.8 leading from the piston pump manifold. The pressure differential is also dependent upon the pressure generated within the first chamber 14.2 of the diaphragm pump during the pumping stroke of the associated piston pump. The latter pressure, in turn, depends upon the setting of the pressure-relief valve 13. If the valve spring 13.4 is highly compressed, relatively high pressures will be generated within the first chamber 14.2 of the diaphragm pump before the adjustable check valve opens. On the other hand, if the valve spring 13.4 of the adjustable check valve is only minimally stressed, then the pressure in the first chamber 14.2 of the diaphragm pump will exceed the pressure within the piston pump manifold 12.6 only to a small extent, and the resulting pressure differential across the diaphragm 14.1 will be minimal.

In the embodiment depicted in the drawing, the liquid which is pumped directly by the multi-piston pump is the liquid carrier to which the additive liquid pumped by the diaphragm pump is added. It will be understood that the liquid directly pumped by the multi-piston pump need not be the liquid carrier, such liquid may be for the sole purpose of driving the diaphragm pump 14 and may be recycled to the piston pump if desired.

To start operation of the diaphragm pump, the handle 15.8 of the check valve 15.4 may be opened to permit the check valve to operate. Liquid which is pumped by the uppermost piston pump in FIG. 3 will thus be afforded a bypass from the first chamber 14.2 of the diaphragm pump to the enlarged manifold 15.2 of the second chamber 14.3, this liquid serving to fill the latter chamber to thus "prime" the diaphragm pump. When the diaphragm pump is operating properly, the handle 15.8 of the valve 15.4 may be turned inwardly to lock the valve in a closed position, the diaphragm pump during its return stroke pulling additive liquid into the second chamber 14.3 from a reservoir of additive liquid (not shown).

From the drawing, and particularly FIG. 3, it will be evident that the pulse pump of the invention may be easily assembled and disassembled. The diaphragm pump housing has three main sections, between two of which is seated the periphery of the diaphragm 14.1. The third main diaphragm pump housing defines the chamber extension 14.7. The housing of the pressure-relief valve 13 may similarly be easily disassembled for repair and replacement of worn parts.

The pulse pump of the invention has many uses in metering one liquid into another, and is particularly useful when harsh chemicals such as hydrofluoric acid, sulfuric acid, and the like are to be metered into a liquid stream. When such harsh chemicals are to be metered, the parts of the diaphragm pump and conduits 17.1 and 17.2 may be made of appropriate, chemical-resistant materials, and the diaphragm itself may be of buna N rubber with an outer, chemical-resistant surface or layer of Teflon or other flexible, chemical-resistant material. As noted above, a multi-piston pump may be provided with several diaphragm pumps which may be employed to meter different liquids, if desired, at various flow rates, into a liquid carrier under high pressure. Various measuring devices such as venturi meters may be employed to monitor the flow rate of the additive liquid, and fine adjustment of the additive liquid flow rate may be obtained by adjustment of a downstream restriction such as needle valve 17.3 in the outflow conduit of the diaphragm pump.

Manifestly, I have provided a high pressure metering pulse pump of inexpensive design and of unique operation whereby an additive liquid may be accurately metered into a high pressure stream of liquid carrier.

While I have described a preferred embodiment of the present invention, it should be understood that various changes, adaptations, and modifications may be made therein without departing from the spirit of the invention and the scope of the appended claims.

What is claimed is:

1. A metering pulse pump for metering an additive liquid into a liquid carrier under high pressure comprising:

a rapidly reciprocable piston pump with an inlet connectable to a source of liquid and an outlet, and an outlet line carrying liquid from the outlet under high pressure;

a pressure-relief valve at the outlet of the piston pump and permitting one-way flow therethrough into the outlet line, the pressure relief valve including a plug and valve seat, a spring biasing the valve into a closed position, and means for varying the spring pressure to control the pressure differential across the valve at which the valve will open;

a diaphragm pump having a housing defining a compartment having a movable diaphragm separating the compartment into a first chamber communicating directly with the outlet of the piston pump upstream of the pressure-relief valve and a second chamber having an inflow port connectable to a source of additive liquid and an outflow port through which additive liquid is pumped by movement of the diaphragm, the inflow and outflow ports respectively having check valves permitting flow only into and out of the second chamber; and a manually closable bleeder duct communicating the first and second diaphragm pump chambers for priming the second chamber with liquid from the first chamber, the bleeder duct having a check valve permitting flow of liquid only from the first chamber to the second chamber when the duct is open.

2. A metering pulse pump for metering an additive liquid into a liquid carrier under high pressure comprising:

a rapidly reciprocable piston pump with an inlet connectable to a source of liquid carrier, an outlet, and an outlet line carrying the liquid carrier from the outlet under high pressure;

a diaphragm pump having a housing defining a compartment having a movable diaphragm separating the compartment into a first chamber communicating directly with the outlet of the piston pump and a second chamber having an inflow port connectable to a source of additive liquid and an outflow port communicating with the high pressure outlet line of the piston pump and through which additive liquid is pumped by movement of the diaphragm, the inflow and outflow ports respectively having check valves permitting flow only into and out of the second chamber; and a unidirectional flow pressure-relief valve mounted at the outlet of the piston pump to limit the pressure developed in the first chamber of the diaphragm pump during a pumping stroke of the piston pump, the pressure relief valve having a valve seat, inner and outer coaxial helical valve springs, and a plug having a surface configured to receive adjacent ends of the helical springs, the opposite end of the outer spring being rigidly supported within the valve, and the opposite end of the inner spring being axially movable to vary the continuous compressive force exerted by the latter spring upon the valve plug, the pressure-relief valve being openable upon application of a pre-set pressure differential thereacross, the length of a diaphragm pumping stroke corresponding to a rapid piston pump stroke thus depending upon said pre-set pressure differential.

3. A metering pulse pump for metering an additive liquid into a liquid carrier under high pressure comprising:

a piston pump with an inlet connectable to a source of liquid, and an outlet and capable of rapid reciprocation;

a pressure relief valve at the outlet of the piston pump and comprising a plug, a valve seat receiving the plug, inner and outer coaxial helical valve springs biasing the plug against the valve seat, a housing enclosing the plug, valve seat, and helical springs, a valve stem threaded into the housing for axial movement in response to axial rotation of the stem, the outer end of the stem projecting from the housing for external, manual rotation, and the inner end of the stem terminating in a centering rod which extends into and centers the inner helical spring, the centering rod having spaced from its inner end an outwardly projecting shoulder defining a spring seat against which one end of the inner helical spring abuts, axial movement of the valve stem thus varying the pressure which the inner helical spring exerts upon the plug;

a diaphragm pump having a housing defining a compartment having a movable diaphragm separating the compartment into a first chamber communicating directly with the outlet of the piston pump upstream of the pressure-relief valve, and a second chamber having an inflow port connectable to a source of additive liquid and an outflow port through which the additive liquid is metered, the inflow and outflow ports respectively having check valves permitting flow only into and out of the second chamber.

4. A metering pulse pump for metering an additive liquid into a liquid carrier under high pressure comprising:

a piston pump with an inlet connectable to a source of liquid, and an outlet and capable of rapid reciprocation;

a pressure-relief valve at the outlet of the piston pump;

a diaphragm pump having a housing defining a compartment having a movable diaphragm separating the compartment into a first chamber communicating directly with the outlet of the piston pump upstream of the pressure-relief valve, and a second chamber having an inflow port connectable to a source of additive liquid and an outflow port through which additive liquid is metered, the inflow and outflow ports respectively having check valves permitting flow only into and out of the second chamber; and a manually closable bleeder duct communicating the first and second diaphragm pump chambers for priming the second chamber with liquid from the first chamber, the bleeder duct having a check valve permitting flow of liquid only from the first chamber to the second chamber when the duct is open.

5. The metering pulse pump of claim 4 wherein said piston pump is one unit of a multi-piston pump having an inlet manifold and an outlet manifold for collectively supplying liquid to and receiving high pressure liquid from each piston pump, the outflow port of the diaphragm pump communicating with the outlet manifold of the multi-piston pump.

6. The metering pulse pump of claim 4 wherein the bleeder duct includes a housing defining a conduit communicating the first and second chambers of the diaphragm pump, a valve seat internally of the housing, a ball plug seatable against the valve seat to restrain flow from the second to the first chamber of the diaphragm pump, and a valve pin threaded into the bleeder duct housing, the valve pin having one end extending from the housing for external operation and having its other end extending inwardly of the housing to engage the ball plug and to seat the latter against the valve seat when the pin is advanced inwardly of the housing.

7. The metering pulse pump of claim 4 wherein the housing of the diaphragm pump defines an elongated chamber extending between the first chamber of the diaphragm pump and the outlet of the piston pump, the diaphragm pump including a helical spring, a spring centering pin extending through the helical spring into the elongated chamber and there terminating in a helical spring seat abutting one end of the helical spring, the centering pin being attached at its other end centrally of the diaphragm, the diaphragm pump housing including a plurality of internal projections extending into the first chamber, the projections being spaced circumferentially from each other and from the spring centering pin to allow axial movement of the centering pin and to permit free liquid communication between the first chamber of the diaphragm pump and the elongated chamber, the projections defining at one end of a seat against which the diaphragm may rest when in its retracted position, and the projections at their other ends defining an inwardly extending helical spring seat against which the other end of the helical spring abuts.

8. The metering pulse pump of claim 7 wherein the helical spring seat at the end of the spring centering pin is movable axially of the pin to permit the compressive force of the spring to be varied.

9. A metering pulse pump for metering an additive liquid into a liquid carrier under high pressure and comprising:

a piston pump with an inlet connectable to a source of liquid and an outlet, and capable of rapid reciprocation through pumping and return strokes and drawing substantially no vacuum at its outlet during the return stroke;

a diaphragm pump having a housing and a diaphragm dividing the housing into a first chamber communicating directly with the outlet of the piston pump and a second chamber having an inflow port connectable to a source of additive liquid and an outflow port through which additive liquid is metered, the diaphragm moving from a retracted position through its pumping stroke in response to pressure within the first chamber generated by the piston pump, the inflow and outflow ports of the second chamber respectively having check valves permitting flow only into and out of the second chamber, the diaphragm pump including a spring urging the diaphragm into its retracted position for returning the diaphragm to the latter position following a pumping stroke; the first and second chambers communicating through a manually closable bleeder duct having a check valve permitting flow only from the first chamber to the second chamber when the duct is open to prime the second chamber;

a unidirectional flow pressure-relief valve mounted at the outlet of the piston pump to limit pressure developed in the first chamber of the diaphragm pump during a pumping stroke of the piston pump, the pressure-relief valve having a plug and valve seat and a valve spring biasing the valve into a closed position, the valve including an externally operable valve stem having an internal spring seat against which the valve spring bears, operation of the valve stem varying the force exerted by said valve spring to thus vary the pressure differential across the valve at which the valve will open, whereby the pressure developed in the first chamber of the diaphragm pump, and hence the length of a diaphragm pumping stroke corresponding to a rapid piston pump stroke, may thus be predeterminally varied by varying the spring force of the pressure-relief valve spring.

10. The metering pulse pump of claim 9 including an outlet manifold communicating with the piston pump downstream of the pressure-relief valve, and an outflow conduit communicating the outflow port of the diaphragm pump with the outlet manifold, whereby the additive liquid metered by the diaphragm pump is added to the liquid pumped by the piston pump.

11. A metering pulse pump for metering an additive liquid into a liquid carrier under high pressure and comprising:

a multi-piston pump having inlet and outlet manifolds, the inlet manifold communicating with a source of liquid carrier, the multi-piston pump including a plurality of piston pumps each having an inlet and an outlet communicating respectively with the inlet and outlet manifolds and each capable of rapid reciprocation through pumping in return strokes and drawing substantially no vacuum at its outlet during the return strokes;

at least one of the piston pumps having an associated diaphragm pump, the latter having a housing and a diaphragm dividing the housing into a first chamber communicating directly with the outlet of the piston pump and a second chamber having an inflow port connectable to a source of additive liquid and an outflow port through which additive liquid is metered, the diaphragm moving from a retracted position through its pumping stroke in response to pressure within the first chamber generated by the piston pump, the inflow and outflow ports of the second chamber respectively having check valves permitting flow only into and out of the second chamber and the outflow port having a conduit communicating with the outlet manifold of the multi-piston pump to inject additive liquids into the carrier liquid pumped by the multi-piston pump, the diaphragm pump including a spring urging the diaphragm into its retracted position for returning the diaphragm to the latter position following a pumping stroke and a manually closable bleeder duct communicating the first and second chambers, the duct having a check valve permitting flow only from the first chamber to the second chamber when the duct is open;

each piston pump which has an associated diaphragm pump additionally including a unidirectional flow pressure-relief valve mounted at the outlet of the piston pump to limit pressure developed in the first chamber of the diaphragm pump during a pumping stroke of the piston pump, the pressure-relief valve having a plug and a valve seat and a valve spring biasing the valve into a closed position, the valve including an externally operable valve stem having an internal spring seat against which the valve spring bears, operation of the valve stem varying the force exerted by the valve spring to thus vary the pressure differential across the valve at which the valve will open, whereby the length of a diaphragm pumping stroke corresponding to a rapid piston pump stroke may thus be predeterminally varied by varying the spring force of the pressure-relief valve.

12. The metering pulse pump of claim 11 wherein said diaphragm pump includes confronting spring seats attached respectively to the diaphragm pump housing and the diaphragm, and a helical spring mounted between the spring seats.

* * * * *